United States Patent [19]

Lemke et al.

[11] 4,233,331

[45] Nov. 11, 1980

[54] METHOD OF SECURING OPENER KEY TO A CONTAINER USING ORIENTED POLYPROPYLENE FILM WITH SOLVENTLESS ACRYLIC ADHESIVE

[75] Inventors: Harold C. Lemke, Grayslake; Stanley E. Rohowetz, Barrington, both of Ill.

[73] Assignee: American Can Company, Greenwich, Conn.

[21] Appl. No.: 929,489

[22] Filed: Jul. 31, 1978

[51] Int. Cl.[3] ..... B65B 55/02; B65B 61/18; B32B 31/00; B29C 27/20

[52] U.S. Cl. ..... 426/407; 426/131; 156/85; 156/87; 156/332; 156/521; 53/133; 53/412; 53/425

[58] Field of Search ..... 220/274; 156/84, 85, 156/86, 332, 521; 426/126, 131, 407; 53/133, 412, 425

[56] References Cited

U.S. PATENT DOCUMENTS

| | | | |
|---|---|---|---|
| 305,680 | 9/1884 | Drake | 220/274 |
| 2,027,624 | 1/1936 | Bastow | 40/307 |
| 2,107,311 | 2/1938 | Strickler | 156/521 X |
| 2,456,467 | 12/1948 | Swedlow | 156/332 |
| 2,532,166 | 11/1950 | Hook | 220/274 |
| 2,847,340 | 8/1958 | Joosten | 156/291 |
| 2,859,200 | 11/1958 | Lappala | 156/332 X |
| 2,921,045 | 1/1960 | Di Martino | 156/332 X |
| 2,996,177 | 8/1961 | Sproull et al. | 206/0.81 |
| 3,110,554 | 11/1963 | Yazumi | 156/85 X |
| 3,565,738 | 2/1971 | Kirkpatrick | 229/62 |
| 3,716,433 | 2/1973 | Plummer | 156/85 |
| 3,874,034 | 4/1975 | Clayton | 24/30.5 P |

OTHER PUBLICATIONS

Data Sheet-J-Lar II ®Polypropylene Clear Tape, Permacel®, Index 1024, 1976.

*Primary Examiner*—John T. Goolkasian
*Assistant Examiner*—Lois E. Rodgers
*Attorney, Agent, or Firm*—Robert P. Auber; George P. Ziehmer; Aaron Passman

[57] ABSTRACT

The present invention pertains to a machine and method of adhering a can opening key to a container and the article formed by such method and machine. More specifically, this invention pertains to the taping of a can opening key to a can body wall by means of a continuous motion high speed machine for applying a polymeric film carrying an adhesive on a surface thereof.

5 Claims, 4 Drawing Figures

METHOD OF SECURING OPENER KEY TO A CONTAINER USING ORIENTED POLYPROPYLENE FILM WITH SOLVENTLESS ACRYLIC ADHESIVE

BACKGROUND OF THE INVENTION

A well known type of container having a wide spread use today is the so called tearing strip container which is opened by means of a slotted key which engages and removes a portion of the circumference of the can that has been defined and weakened by score lines. It is the general practice to equip each such tearing strip with an end tab and cooperating key; the latter preferably secured to the top end wall of the container. It is the novel technique by which this key is affixed to the can at high speed that this invention is directed.

Presently, the usual methods of affixing the key to a can wall are by spot welding or soldering of a portion of the key to subjacent metal of the can wall. However, certain disadvantages are associated with such processes. Due to the thin gauge of metal wall to which the key is attached the localized high temperature which burns through the metal can making same nonhermetic. This localized high temperature also has a tendency to char and degrade the metallic or organic coating on the inside and/or outside of the can wall, thereby exposing core metal which is subject to corrosion both from the atmosphere and from the contents packed in the container. Furthermore, soldering lead is not acceptable as a substance for use in food packaging. In addition, the common welding and soldering methods are not readily applicable to certain metals commonly used for can bodies and are inapplicable for nonmetallic containers.

In an effort to obviate the disadvantages of spot welding or soldering the keys to the container while retaining the advantages of these methods, i.e., speed of effecting the bond, strength of the bond, ease of key removal for use and low cost, attempts have been made to adhere the key to the can end by cements, resins, and hot melts.

Selection of the proper adhesive is essential, but difficult, since the environment to which the adhesive is subject is harsh and unfavorable to most adhesives. For example, vinyl polymers are sensitive to moisture, would degrade during autoclaving and would have inadequate adhesive strength. Similarly, rubber based cements are not only sensitive to water but they tend to age (cold flow) and discolor (yellow); they are also limited as to their operational temperature range. Thermosetting resins and rubbers require heat to cure and as such do not lead themselves to a high speed single step operation and also the latitude as to color (tending to yellow and brown) is limited with resin adhesives. Prior to the present invention, no commercially satisfactory way of quickly bonding the key to any type of container and any way of forming a bond which could be processed through, for example, autoclaving at elevated temperature with high moisture content has been known. Stacked cans with glued keys may stick to each other.

It is, therefore, an object of the present invention to provide a method of quickly attaching an opening key to a container wall without the danger of transmitting heat through the wall.

Still another object of the present invention is to provide a means of joining an opening key with a container wall without effecting adversely the contents of it.

A further object of the present invention is to provide an economical means of attaching an opening key to a can wall at a relatively high speed by means of specially selecting tape.

SUMMARY OF THE INVENTION

In accordance with the objects and to overcome the disadvantages of the prior techniques, a method and apparatus, therefore, are disclosed whereby a uniform strip of polypropylene tape carrying an acrylic adhesive layer is applied in overlying relation to secure a key to the wall of a key openable, tearing strip type container. More particularly, a pressure sensitive adhesive tape is disclosed which secures a key to a container along a containing surface adequate to support the key by means of holding the key securely to the surface of the container wall. The key and the container have juxtaposed planar surfaces which are held together by a strip of tape positioned across the wall and over and about at least a portion of the key. The key has a working end including the mentioned slot and an operative end having a tee handle; both ends are connected by an elongated usually circular (in cross section) shank which provides an excellent site for the tape to cross and hold the key. When removing the key for use, both ends are available for twisting and lifting thereby stressing the tape interface, but shear stresses are resisted by the taped key. Key openable cans come with variously shaped bodies such that the key need not be on an end. If the container has a flat side it could support the key and such that the key does not interfere with indicia on the container or the tear strip feature.

The tape is of a material which can withstand autoclaving without changing color or degradation of the adhesive bond. The tape will also withstand temperature of freezing or below encountered during packing, shipment or storage. The tape is resistant to oils or fats which are present (although in limited amounts) on the container walls during processing. More particularly, if oils or die release materials are present on the formed end or should vegetable fats be present during autoclaving, the bond is relatively insensitive to normal quantities of lubricants and fats.

In order to take advantage of the application ease and speed associated with the use of tape, a machine for continuous application of tape strips and keys is disclosed. The machine is a continuous motion tape applicator for the can opening key. It consists of a can end feeder system, a tape feeder, a tape strip cutter wheel, a key feeder system and a key applicator vacuum wheel. The can ends are continuously fed from the end feeder system to a position for receiving the key. Simultaneously, the tape is pulled off its supply spool and is fed over applicator vacuum wheel cutting anvils. As each anvil passes under the cutter wheel, blades thereon sever a strip of pressure sensitive tape. The adhesive side is disposed outwardly and the tape is retained sticky side out (on the anvil) by vacuum. Each tape strip rotates with its anvil to a station where a key is individually fed and delivered by the key feeder system. The key feeder system includes guide ways for supplying keys stacked therein to a key feed pocket wheel adapted to receive one key within a key pocket on the circumference of the wheel as the wheel rotates beneath and adjacent to the exit of the guide ways. Each key (steel or aluminum) is held in the wheel pocket by tangentially disposed rails until it is near the key applicator vacuum wheel. The key is transferred into a slot on the anvil and attached to the previously applied tape strip (retained by vacuum). Thus, each key is carried by the vacuum held tape and the rails which follow the periphery of the vacuum wheel. A tape and key combination continues around with the applicator vacuum wheel until a point tangent with the end feeder and a container end is reached at which point they are pressed against each other. Thus, the tape, key and end become an assembly. The foregoing assembled container end is then used in preparation of a can for containing food stuff. More specifically, a formed can body having two open ends is made and provided with the requisite scoring for its tearing strip. At the can side seam, a portion of the scored area is provided as a starting tab for the tearing strip. The described end with tape and key is usually used as the top of the can body.

The taped key and container end are then sealed to the can body which is at a subsequent time filled (through the opposite end of the can). The opposite end is then sealed and the can and food are sterilized in an autoclave. During autoclaving the container, key and tape reach approximately 115° C. which tends to shrink the linearly oriented polymeric film of the tape, drawing same tightly down upon the key relative to container end. Tape shrinkage of over 1% has been found to aid in assuring intimate contact between the container and the key. The peel strength of the acrylic adhesive is roughly doubled during autoclaving but the color and appearance of the tape are not perceptably changed by the treatment at elevated temperature with steam. Conversely, the tape must adhere at freezing or lower temperatures as, for example, during packing, storage or shipment. Acrylic adhesives have been tested and found to be particularly stable when subjected to temperature and humidity extremes as well as ultraviolet radiation such as sunlight. The appearance of the tape remains relatively unaffected. In the preferred embodiment, a tape such as J-LAR II polypropylene clear tape manufactured by Permacel has been found to perform satisfactorily. Such a tape is composed of a corona treated polypropylene film which is about 0.06 mm thick and has an adhesive layer of acrylate esters (e.g. methacrylic acid esters) about 0.03 mm thick. The polypropylene is resistant to oils and moisture and can be transparent so as not to adversely impact upon the appearance of the packaged product. Moreover, the adhesive is functional over a broad temperature range from well below freezing to above the boiling temperature for water. The peel strength is normally the force between the tape and the container, however, if by aging or processing that bond sets, the adherence between the polypropylene and the adhesive is such that that interface is destroyed when the tape is removed. While normally the tape and adhesive are designed to be removed together in the above instance the maximum peel strength limiting force is per design.

DETAILED DESCRIPTION OF THE DRAWINGS

Figure 1:
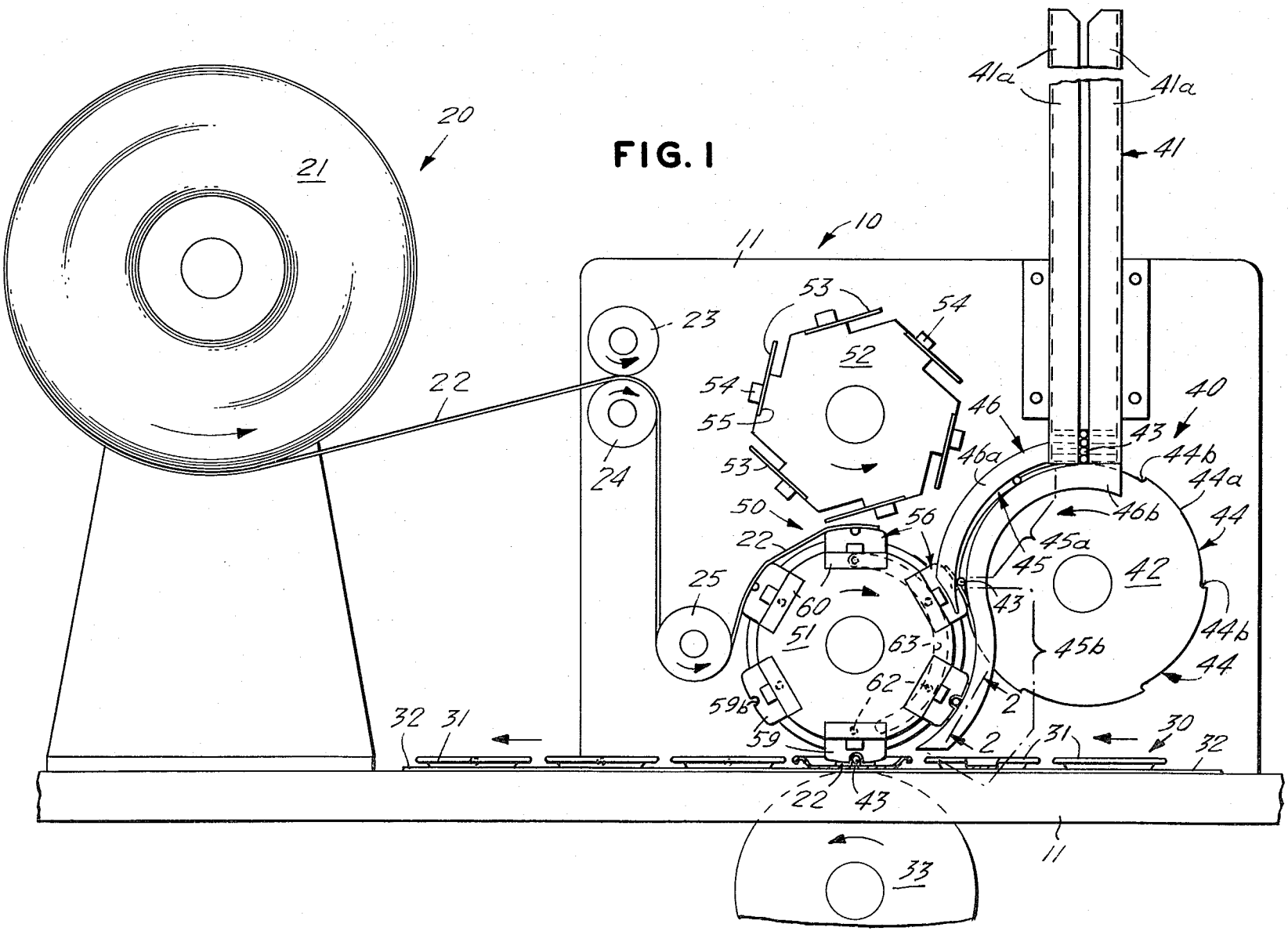
FIG. 1 is a schematic side elevational view of the high speed tape key applying machine in accordance with the present invention.

A high speed machine 10 for applying tapes and keys to the end of a tearing strip container with continuous motion is shown schematically in FIG. 1. The machine 10 includes a tape feeder system 20 for continuously supplying pressure sensitive tape at a predetermined rate adequate to keep pace with the process of applying tapes and keys. Machine 10 also has a container end feeder 30 and a key feeder 40 which cooperate with a vacuum applicator and tape cutoff system 50 to position tapes and keys for assembly and bonding to the container ends. The process is continuous and is intended to operate at a rate of 500 assemblies per minute without interruption.

The tape feeder system 20, FIG. 1, includes a spool of tape 21 mounted in a support plane 11 common to the entire machine 10. The spool 21 is mounted for rotary movement about its center to permit the tape 22 carried on the spool 21 to be pulled off the spool at a predetermined rate. The tape 22 is pulled from the spool 21 by a pair of juxtaposed counter rotating pinch rollers 23 and 24 being the upper and lower rollers, respectively. The angular velocity of rollers 23 and 24 establishes the pull off rate for the tape 22. In the machine 10 of FIG. 1 the adhesive layer on the pressure sensitive tape 22 faces upwardly as the tape is dispensed from the bottom of the spool 21. After the tape 22 leaves the pinch rollers 23 and 24, it is looped downwardly and around an idler 25 which positions the tape 22 across and in alignment with the vacuum applicator and tape cutoff system 50. The adhesive layer faces outwardly therefrom as will be explained in detail.

Figure 2:
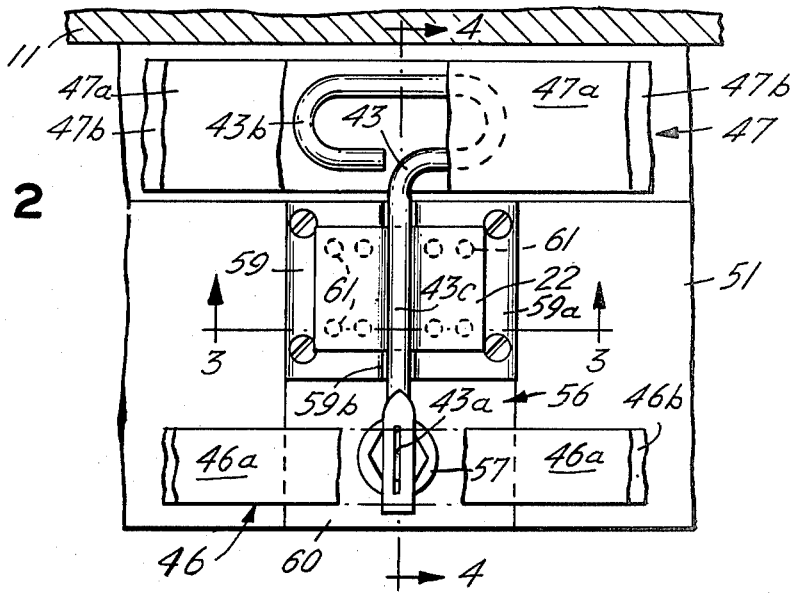
FIG. 2 is an enlarged partial section taken substantially along line 2—2 of FIG. 1 with portions shown cutaway for clarity.
Figure 4:
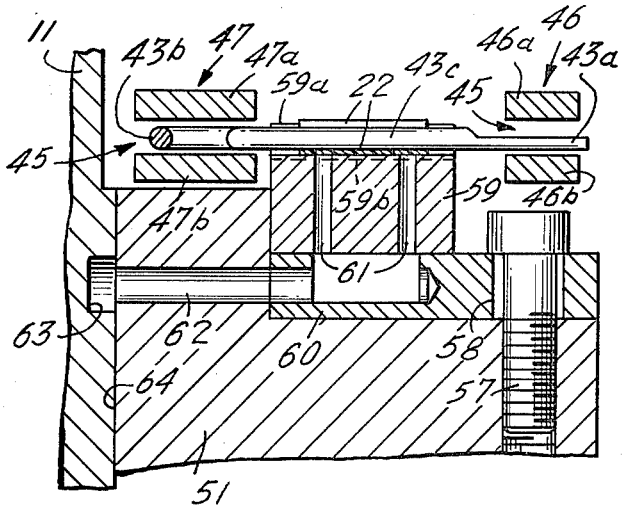
FIG. 4 is an enlarged partial section taken substantially long line 4—4 of FIG. 2 showing the vacuum porting essential for retaining the tape.

The key feeder 40 is located opposite the tape feeder system 20, but is carried on the common plane 11 of machine 10 whereby as the tape 22 is fed to the vacuum applicator and tape cutoff system 50 from one side the keys are fed from the opposite side. More particularly and in accordance with the preferred embodiment, the key feeder 40 includes a key dispensing track 41 and a pocketed feed wheel 42 which rotates beneath the exit of the track 41 for picking a key 43 off the bottom of a stack of keys. The track 41 vertically orients the stack of keys 43 such that a uniform line of keys are established. Each key is planar being formed of a piece of wire and each has a working end including a thorough slot **43*a*, see FIGS. 2 and 4, an operating end having a loop handle 43*b* and therebetween a shank portion 43*c*. The slot 43*a* is designed to accept a tab end of a tear strip container (not shown) for winding clock spring fashion in the usual manner for opening such tear strip cans. The loop handle 43*b* provides a convenient place to hold and twist the key 43. The keys 43 are stacked and oriented identically such that their respective ends are juxtaposed to each other and are so retained by the dispensing track 41**.

Track 41 extends radially upward from a point tangent to the pocket wheel 42, and track 41 includes a pair of oppositely position guide ways **41*a* which are chamferred at their top to facilitate the loading of the track. The space between guide ways 41*a* is slightly larger than the diameter of the shank portion 43*c* whereby the keys 43 rest in stacked relation between the ways 41***a* but are free to move up and down therein as keys 43 are dispensed to the pocket wheel 42. As positioned in FIG. 1 the key handle 43*b* is in back of the guide ways 41*a* such that only the slot end 43*a* is shown.

The circumference of the pocket wheel 42 has six equally spaced receiving pockets 44 which are shaped to pick up a dispensed key 43 (at the lower exit end of guide ways 41*a*) and carry it through a circumannular groove 45 to the vacuum applicator and tape cutoff system 50. The pocket wheel 42 is essentially a circular disc mounted for rotary movement about its center on the common support plane 11 of the machine 10. The six pockets 44 are spaced at 60° intervals about the circumference of the wheel 42 and are shaped identically to permit one key 43 to be carried within the a pocket 44. More particularly, each pocket 44 includes a shallow lead in ram 44*a* which deepens to a depth equal to at least the thickness (diameter) of one key 43. At the innermost end of each ramp 44*a*, there is a drive shoulder 44*b* which is designed to push the lowermost key 43 out of the track 41 and into the groove 45. The wheel 42 rotates counterclockwise such that the locus of the travel of the key 43 is also initially counterclockwise.

The circumannular groove 45 is formed by a pair of front rails 46 and rear rails 47 as shown in FIGS. 1, 2, 3, and 4. The path of the groove 45 is generally serpentine; that is, to say that, it follows the curvature of the pocket wheel 42 in a first portion 45*a* and has the reverse curvature in the second portion 45*b*. Consequently, the inflection point between the first and second portions is of particular importance as it is the position where the transfer of the key 43 carried by the wheel 42 takes place. Each set of guide rails 46 and 47 retains the key 43 within the pocket 44 and against the drive shoulder 44*b* through the transfer (inflection) point where the key 43 is picked up by the vacuum applicator and tape system 50 although the rails 46 and 47 still guide it. The direction of the key travel then becomes clockwise with the vacuum applicator and tape system 50.

From the foregoing it can be appreciated that the tape feeder system 20 supplies tape at a predetermined rate from the left in FIG. 1 and the key feeder 40 supplies individual keys 43 at a predetermined frequency from the right in FIG. 1. The container ends 31 are formed and then supplied on a conveyor end feeder 30 at a point tangent to and below the vacuum applicator and tape system 50 also shown in FIG. 1. The spacing of the container ends 31 on feeder 30 is in accordance with the the frequency with which they are placed upon the conveyor belt 32 and must be in accordance with the desired rate at which the machine 10 is set to operate. Beneath the belt 32 and below system 50 is a bonding wheel 33; it supports the belt 32 under the pressure of bonding. Thus the air is squeezed out from between the interface of the tape, key and container. Simply stated, there must be a container end 31 available and positioned to receive a tape 22 and key 43 combination as same is provided by the vacuum applicator and tape cutoff system 50, and the latter will be explained in detail in the following.

A vacuum wheel 51 (for carrying tape strips) and a cutoff blade wheel 52 (for severing small strips of tape 22 at predetermined intervals) interface to form the vacuum applicator and tape cutoff system 50. The blade wheel 52 and the vacuum wheel 51 each have six stations spaced at 60° intervals about their respective circumferences and each wheel is mounted for rotary movement on the common support 11 of the machine 10 such that alignment with the feeders is assured. The tape 22 is fed into a space between the cutoff blade wheel 52 at a predetermined rate whereby a strip of tape is removed at a set frequency and above a particular position on the vacuum wheel 51. The blade wheel carries six tool steel blades 53 each adjustably mounted by a screw 54 and a blade slot 55 whereby each blade 53 can be shifted relative to the circumference of the blade wheel 52 to precisely position a given blade relative to its adjacent blades 53 and to its wheel location. Similarly, each blade 53 can be removed for replacement or sharpening. The blades 53 extend tangentially to position a piercing edge at a specific radial distance.

In a similar fashion six tape supporting mandrels 56 are positioned on the vacuum wheel by screws 57 in slots 58 to be carried at 60° intervals and they are also adjustable and removable. The vacuum wheel 51, the pocketed feed wheel 42 and the blade cutoff wheel 52 are designed to have equal diameters at their working locuses and are geared (not shown) to rotate at the same speed so that the six stations on each are kept in phase with one another and are indexed to cooperatively work together. The vacuum wheel 51 rotates clockwise while the pocketed feed wheel 42 and the cutoff blade wheel 52 rotate counterclockwise.

Figure 3:
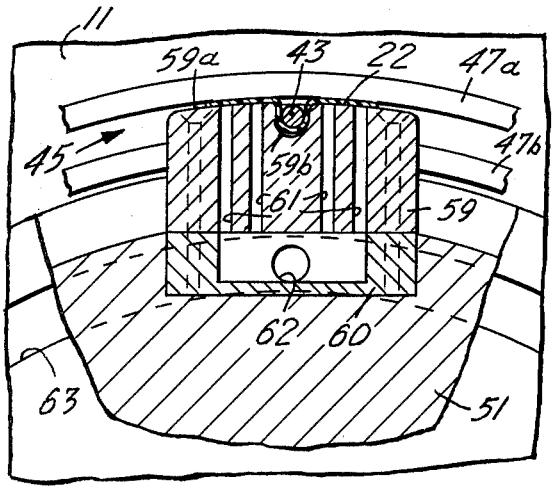
FIG. 3 is an enlarged partial section taken substantially along line 3—3 of FIG. 2 and illustrates the retention of the tape and key in the mandrel slot and the guide rails for the key.

Each mandrel 56 has an upper pedestal end 59, FIG. 3, and a mounting base 60. The top surface of the end 59 includes an anvil surface 59*a* and a key groove 59*b*. The anvil surface 59*a* is a radially disposed circumferential surface which carries and supports the strip of tape 22 with its adhesive layer outwardly, or away from the vacuum wheel 51. In operation, the tape feeder system 20 supplies tape at the predetermined rate and positions the free end of the tape 22 across the vacuum wheel 51 mandrel surface. The timing and complimentary rotation of the various wheels assures that the cutoff blade meets the anvil severing a preset strip of tape. In the preferred embodiment the tape 22 is about 13 mm wide and the cutoff is made to form a 20 mm long strip. Such a strip is, shown in FIGS. 2 and 3, laid adhesive side up across the anvil surface 59*a*. Vacuum applied to beneath the tape where it rests across anvil by surface 59*a* suitable porting which will be explained in detail, sucks the sides of the strip of tape 22 down against the anvil surface 59*a*. More specifically, there are vacuum wheel ports 61 radially disposed inside the vacuum wheel 51. Each port 61 extends from the surface of the anvil 59*a* to a common chamber in communication with a transverse connection port 62 which extends across the thickness of the wheel 51 to a vacuum supply transfer recess 63. That is to say that, the rear thrust face 64 of wheel 51 rotates in mating sliding engagement with the common planar support surface 11 of the machine 10. As shown in broken lines in FIG. 1, recess 63 is configured in an elongated arcuate shape to provide vacuum (suction) at the anvil surface 59*a* during a portion of each revolution of the wheel 51 whereby the tape strip 22 is retained against the mandrels 56 for approximately 180° of rotation. More particularly, the tape strip 22 is held against the mandrel surface 56 within the groove 59*b* from the point it is severed by the cutoff blade, past the point at which a key shank 43*c* is fed into the tape covered key groove 59*b* until the tape and key combination is above the belt 32 and in alignment with a container end 31. The ports 61 hold the tape strip 22 taut across grove 59*b* until the key shank 43*c* is pressed against the tape 22 forcing same into the groove 59*b*.

The combination is then pressed against the end 31 which is supported by the belt 32 and a bonding pressure roll 33 located beneath the belt. The bonding pressure roll 33 provides support for the belt 32 and end 31 during bonding.

The invention and its many advantages will be understood from the preceeding description, and changes in form, construction, selection and arrangement of materials and components or changes in the steps of the method and process described can be made without departing from the broader aspects of the system as set forth in the claims that follow.

We claim:

1. A method of securing a key for opening a sealed container to a portion of the container at high speed wherein the key includes a working end and an operating end with a middle portion therebetween said method being continuous and comprising:

(a) providing a container end for hermetically closing a container for carrying food stuff to the exclusion of environs which would taint and spoil the food stuff, said container end having a surface adequate for supporting the key, and said container including a portion which is key openable for removal of the food stuff;

(b) dispensing a strip of flexible polymeric oriented polypropylene film which carries a solventless acrylic adhesive layer which when heated becomes stickier on one surface thereof;

(c) placing a key across said adhesive layer for carrying same in the plane of the adhesive to form an assembly thereof;

(d) orienting a surface of the key adequate for supporting the key adjacent to and parallel with the support surface of the container;

(e) applying the tape and key assembly, at over 100 per minute, with the solventless acrylic adhesive surface of the polypropylene strip across the end surface of the container over and above the shank of the key for securing the oriented key to the container surface in a manner which permits removal of the key by subjection of the interface between the key and the container to tensile and bending loadings but which resists disorientation of the key responsive to shear loads between the key and the surface;

(f) filling the container with the food stuff and hermetically sealing it; and (g) autoclaving at a sterilizing temperature the sealed container and key combination in order to sterilize the food stuff without degradation to the surface of the strip or the interface but with selected shrinkage to draw the key and end into more intimate engagement and increasing the stickiness of the adhesive layer.

2. The method of claim 1 in which said tape is substantially transparent and said adhesive is a mixture of transparent methacrylic acid esters which when heated adhere better.

3. The method of claim 1 wherein the application of the strip includes the step of pressing the non-adhesive surface for removal of air captured at the adhesive interface to maximize the interface area.

4. The method of claim 1 wherein said shank portion is generally circular in cross section such that the applied strip surrounds at least part of said portion and extends therefrom across said surface forming said interface across said surface and about and over said shank.

5. The method of claim 1 wherein said key includes a slot at its working end and a lever arm at its operating end and said key openable portion is a band of container material defined by a pair of parallel scores which extend about one circumference of the container forming a loop with an extending tab at one point, whereby said tab may be engaged by said slot and said key can be twisted to wind the end tab about said key for controlled removal of said band portion from the container.

* * * * *